United States Patent [19]

Giraudeau et al.

[11] Patent Number: 4,992,759

[45] Date of Patent: Feb. 12, 1991

[54] FILTER HAVING ELEMENTS WITH DISTRIBUTED CONSTANTS WHICH ASSOCIATE TWO TYPES OF COUPLING

[75] Inventors: Patrick Giraudeau, Paris; Philippe Rousseau, Cesson Bourg, both of France

[73] Assignee: Thomson-CSF, Paris, France

[21] Appl. No.: 175,211

[22] Filed: Mar. 30, 1988

[30] Foreign Application Priority Data

Mar. 31, 1987 [FR] France ..... 87 04486

[51] Int. Cl.[5] ..... H01P 1/203

[52] U.S. Cl. ..... 333/204; 333/219

[58] Field of Search ..... 333/204, 205, 219, 235, 333/203

[56] References Cited

U.S. PATENT DOCUMENTS

| | | | |
|---|---|---|---|
| 3,504,618 | 4/1970 | McKee | 333/203 |
| 4,418,324 | 11/1983 | Higgins | 333/204 |
| 4,423,396 | 12/1983 | Makimoto et al. | 333/204 |
| 4,701,727 | 10/1987 | Wong | 333/204 |
| 4,731,596 | 3/1988 | Cruchon et al. | 333/205 X |
| 4,740,765 | 4/1988 | Ishikawa et al. | 333/206 |

FOREIGN PATENT DOCUMENTS

| | | | |
|---|---|---|---|
| 0069651 | 1/1983 | European Pat. Off. . | |
| 0117178 | 8/1984 | European Pat. Off. . | |
| 2714181 | 10/1978 | Fed. Rep. of Germany | 333/203 |
| 2509535 | 1/1983 | France . | |
| 8601 | 1/1987 | Japan | 333/204 |
| 91001 | 4/1987 | Japan | 333/204 |
| 1262603 | 10/1986 | U.S.S.R. | 333/204 |
| 1277256 | 12/1986 | U.S.S.R. | 333/204 |
| 1309125 | 5/1987 | U.S.S.R. | 333/204 |
| 1352563 | 11/1987 | U.S.S.R. | 333/204 |

OTHER PUBLICATIONS

Patent Abstracts of Japan, vol. 10, No. 27 (E-378) [2084], Feb. 4, 1986, JP-A-60 185 402 (Nippon Denki K.K.) 9/20/1985.

*Primary Examiner*—Benny Lee

*Attorney, Agent, or Firm*—Oblon, Spivak, McClelland, Maier & Neustadt

[57] ABSTRACT

A filter having elements with distributed constants is made up of resonators providing two different types of coupling. The use of two types of coupling makes it possible to obtain the desired geometry and in particular to limit the coupling between variable capacitors in the construction of combline filters as well as the construction of filters having two transmission zeros and involving the use of hairpin resonators.

10 Claims, 8 Drawing Sheets

FILTER HAVING ELEMENTS WITH DISTRIBUTED CONSTANTS WHICH ASSOCIATE TWO TYPES OF COUPLING

BACKGROUND OF THE INVENTION

1. Field of the Invention

This invention is primarily concerned with a filter having elements with distributed constants which make use of at least two different types of coupling.

2. Description of the Prior Art

It is known to construct filters having distributed constants. A filter of this type is provided with resonators. The signal propagates by coupling between the consecutive resonators of the filter. Distributed-constant filters are fabricated by making use of the stripline technology, the resonators being deposited by metallization on one face of a low-loss dielectric whilst the metallization of the second face constitutes the ground plane.

It is also known to construct so-called combline filters having straight resonators, the ends of which are connected to the ground plane on the one hand directly and on the other hand through a variable capacitor.

Filters of the combline type present difficulties in regard to construction and achievement of the desired filtering action.

The proximity of the variable capacitors gives rise to problems of available space for the construction of the filter.

Moreover, it was believed prior to conception of the present invention that the fact of adding lumped-constant elements in a distributed-constant filter had the effect of increasing the bulk of this latter.

As disclosed in the article entitled "Narrow-band stripline or microstrip filters with transmission zeros at real and imaginary frequencies" by Kari T. Jokela, published in "IEEE transactions on microwave theory and techniques", vol. MTT-28, No. 6, June 1980, it is also known to construct bandpass filters having very high attenuations at the ends of the pass-band. The filters described in this article have an even number of distributed-constant resonators in which resonators placed symmetrically with respect to the center of the filter are coupled.

The filters in accordance with the present invention have distributed-constant resonators. The signal propagates by coupling between the constituent resonators of the filter. As will be explained hereinafter, the filters in accordance with the present invention have at least two types of coupling between successive resonators.

In the case of filters which make use of U-shaped resonators (also designated as hairpin resonators), the reversal of certain U-shaped resonators with respect to the arrangement of a filter of conventional type permits easy connection of a transversal coupler between resonators disposed symmetrically with respect to the center of the filter, for example in order to construct a filter having two very substantial attenuation zones which are symmetrical with respect to the center frequency of the filter. Filters of this type can be employed for example in order to form envelopes or in order to remove frequency side lobes from an electric signal.

When two types of coupling of a combline filter are employed, the variable-capacitance capacitors are spaced at a greater distance. This has the effect of achieving on the one hand a reduction in capacitive coupling between capacitors and on the other hand easier implantation of said variable-capacitance capacitors in the filters according as these capacitors are located at a greater distance from each other.

SUMMARY OF THE INVENTION

The invention is primarily directed to a microwave filter having a plurality of resonators, each resonator being so arranged that at least one end can be connected to ground, two successive resonators being provided with an electromagnetic coupling zone, the first and last resonators being connected to filter connection means. The filter is essentially provided with at least one coupling zone between successive resonators so arranged that the resonator ends which can be connected to ground are located on the same side of the filter axis, and with at least one coupling zone between successive resonators so arranged that the resonator ends which can be connected to ground are located in opposite relation.

BRIEF DESCRIPTION OF THE DRAWINGS

In FIGS. 1 to 15, the same references have been employed to designate the same elements.

DESCRIPTION OF THE PREFERRED EMBODIMENTS

Figure 1:
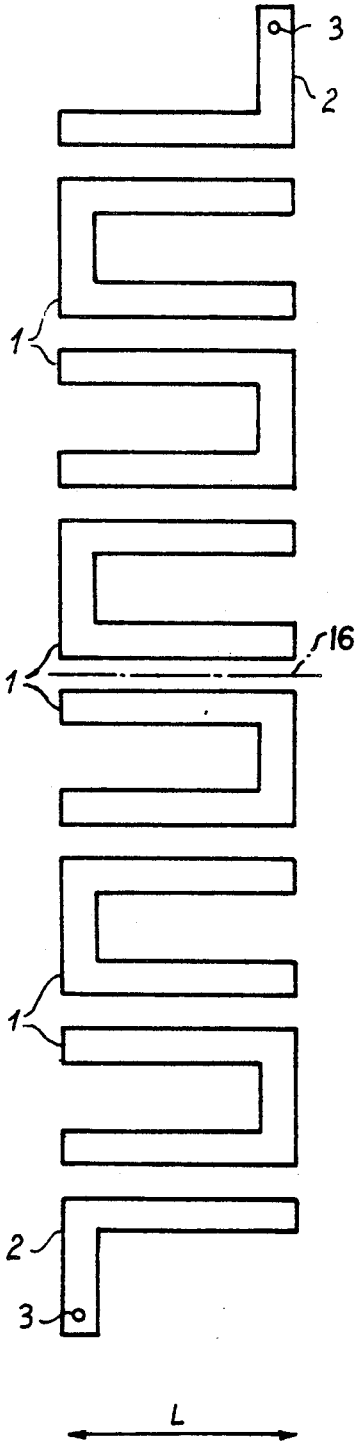
FIG 1 PRIOR ART
FIG. 1 is a diagram of a first example of construction of a filter of known type.

In FIG. 1, there is shown one example of construction of distributed-constant filters of known type. The filter of FIG. 1 has a plurality of U-shaped or so-called hairpin resonators. Each resonator has two arms of length L disposed symmetrically and at right angles with respect to a base. The resonators 1 are disposed in staggered relation so as to ensure that the arms of two successive resonators 1 provide an electromagnetic coupling.

In the example illustrated, the filters consist of six hairpin resonators 1. The first and last hairpin resonator 1 are coupled with connectors 2.

In the example illustrated in the figure, the connectors 2 have an arm of length L which is parallel to the arms of first and last resonators 1 as well as an orthogonal metallized strip terminating in a metallized hole 3.

The electrical connection is established at the location of the metallized hole 3.

The filters illustrated in FIG. 1 have a disadvantage in that it is extremely difficult to form the coupling by means of a capacitor between two hairpin resonators 1 which are symmetrical with respect to the transverse axis 16 of the filter. In fact, the resonators placed symmetrically with respect to a transverse axis 16 of the filter have U-bases on opposite sides of the filter and the metallizations which are intended to join these two bases of the first and last resonators or of the second and fifth resonators, for example, would be liable to disturb the operation of the filter.

Figure 2:
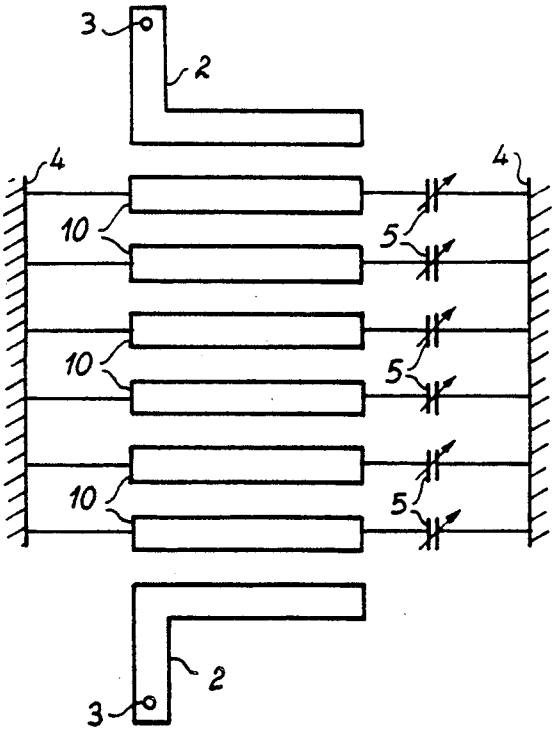
FIG 2 PRIOR ART
FIG. 2 is a second example of construction of a filter of known type.

In FIG. 2, there is shown a filter of known type designated as a combline filter. The filters illustrated in FIG. 2 have a plurality of straight resonators 10. The straight resonators 10 are placed in parallel relation to each other. Each straight resonator 10 is connected at a first end to ground 4 and at a second end to a first plate of a variable capacitor 5. The second plate of the variable capacitor 5 is connected to ground 4.

The filter illustrated in FIG. 2 is subject to parasitic couplings between the variable capacitances 5 and the resonator 10 and between the capacitors themselves by reason of their proximity. Moreover, the space requirements of the variable capacitors 5 gives rise to problems at the level of the geometrical construction of the filter as a result of their proximity.

Figure 3:
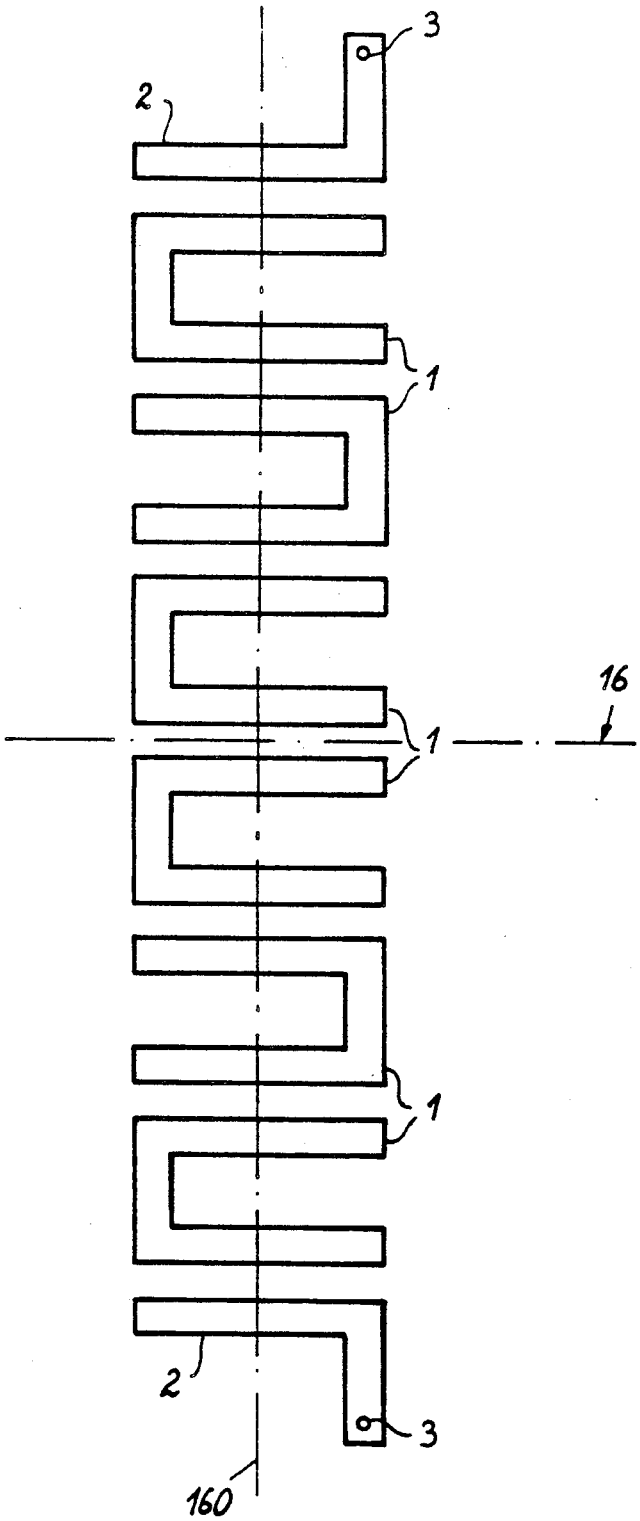
FIG. 3 is a first example of construction of a filter in accordance with the present invention.

In FIG. 3, there is shown a first example of construction of a filter in accordance with the present invention. The filter of FIG. 3 is made up of hairpin resonators 1. The first three hairpin resonators 1 are disposed in staggered relation. The fourth hairpin resonator 1 has a base which is located on the same side as the third resonator 1. In fact, in the example of construction illustrated in FIG. 3, the fourth resonator 1 as well as the fifth and the sixth resonators are disposed symmetrically with respect to the transverse axis 16 of the filter with respect to the third, second and first hairpin resonators 1. The ends of the arms of each hairpin resonator can be connected to ground (not shown in FIG. 3). Thus the couplings between the first and the second resonators 1, the second and the third resonators 1, the fourth and the fifth resonator 1 and the fifth and the sixth resonators 1 are of the same type, the ends of the hairpin arms which can be connected to ground being in opposite relation with respect to the axis 160. On the other hand, in the coupling between the third and the fourth resonators 1, the ends of the arms of the resonators which can be connected to ground are on the same side of the axis 160. The coupling between the third and the fourth resonators 1 is of a different type to the couplings between the other resonators 1.

The fact that two different types of coupling are available in the same filter which makes use of hairpin resonators having an even number of resonators 1 makes it possible to arrange hairpin resonators 1 symmetrically with respect to the transverse axis 16 of the filter with the bases located on the same side of the filter. These bases are intended to be connected by means of a capacitor, for example, so as to form a filter having two zones of high attenuation which are arranged symmetrically with respect to the center frequency of the filter.

The axis 16 is an axis of symmetry of the filter. The centroid of the filter constitutes the intersection of the axis 16 with a longitudinal axis 160 at right angles to the axis 16.

Figure 4:
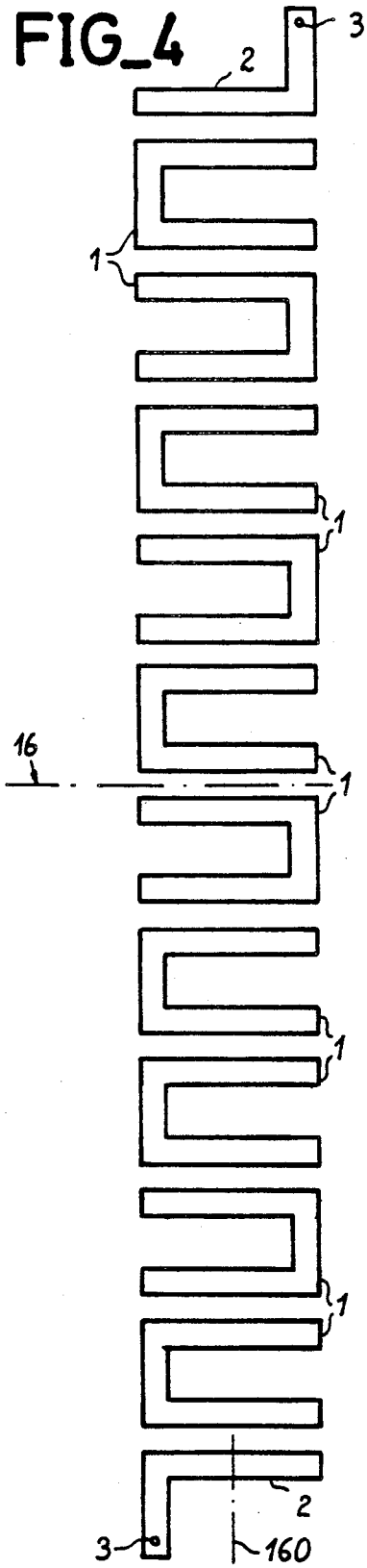
FIG. 4 is a second example of construction of a filter in accordance with the present invention.

In FIG. 4, there is shown a second example of construction of a filter in accordance with the present invention and provided with hairpin resonators 1. The filter illustrated in FIG. 4 consists of ten resonators. The first seven hairpin resonators from the top of the figure are disposed in staggered relation as in a filter of conventional type. The seventh and eighth resonators have arms located on the same side. The last three hairpin resonators 1, the eighth, the ninth and the tenth, are arranged in staggered relation.

In the example illustrated in FIG. 4, it is an easy matter to establish an electrical connection, for example by means of a capacitor (not shown in the drawings) between the first hairpin resonator 1 and the tenth hairpin resonator 1, between the second hairpin resonator 1 and the ninth hairpin resonator 1 or between the third hairpin resonator 1 and the eighth hairpin resonator 1.

The filters of FIGS. 3 and 4 are given as non-limitative examples of arrangements of hairpin resonators 1. Other arrangements such as, for example, those involving several changes of coupling, also come within the scope of the present invention.

Figure 5:
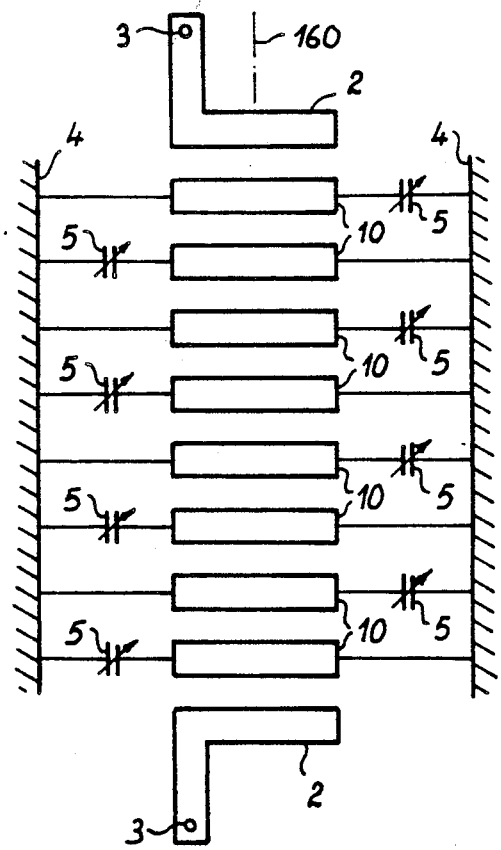
FIG. 5 is a third example of construction of a filter in accordance with the present invention.

In FIG. 5, there is shown a filter of the combline type in accordance with the present invention. The filters of FIG. 5 consist of a plurality of straight resonators 10. The straight resonators are arranged in parallel relation to each other. The first straight resonator 10 is connected through a first end to ground 4 and through a second end to a first plate of a variable capacitor 5. The second plate of the variable capacitor 5 is connected to ground 4.

The second straight resonator 10 is connected at a first end to a first plate of a variable capacitor 5. The second plate of said variable capacitor is connected to ground 4. The second end of the straight resonator 10 is connected to ground 4, and so on in sequence.

The variable capacitors 5 are thus located at a greater distance from each other than in a combline filter of conventional type. This accordingly solves the problem of overcrowding of variable capacitors 5 and reduces parasitic coupling between these capacitors.

Figure 6:
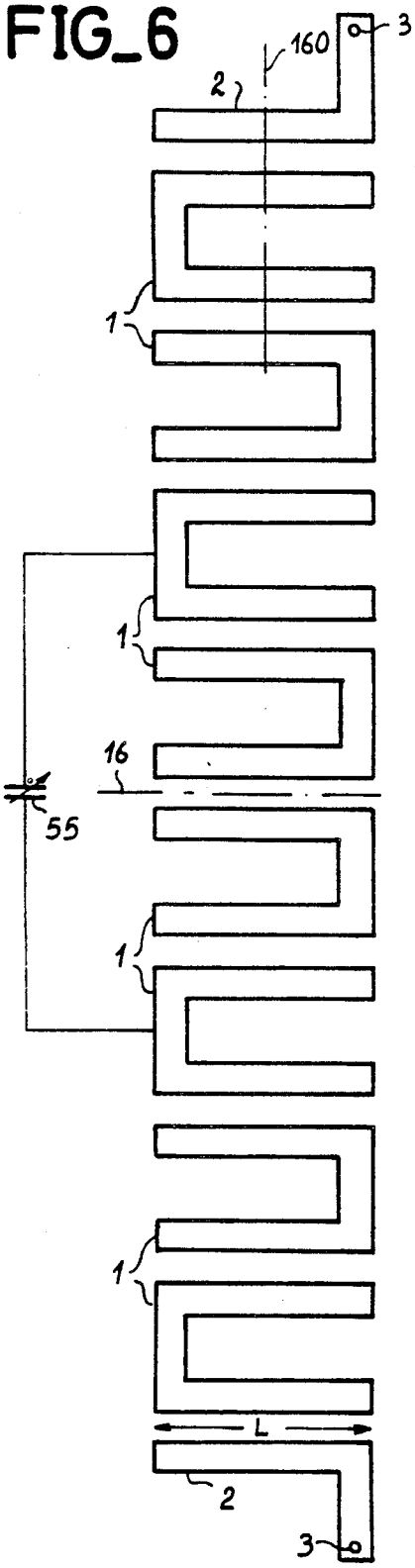
FIG. 6 is a fourth example of construction of a filter in accordance with the present invention.

In FIG. 6, there is shown a filter in accordance with the present invention for obtaining two zones having high attenuations, for example with respect to the mid-band operating frequency of the filter. These high-attenuation zones are also known as the zero of the filter.

In the example illustrated in FIG. 6, the filters are made up of eight hairpin resonators 1 which are disposed symmetrically with respect to the transverse axis 16 of the filter. The bases of the third and of the sixth hairpin resonators 1 are connected to each other through a variable capacitor 55. The capacitor 55 serves to adjust the curve of response of the filter of FIG. 6.

It is readily apparent that other resonators disposed symmetrically with respect to the transverse axis of the filter 16 can be connected by means of a capacitor 55. For example, it is possible to connect the second and the seventh hairpin resonators 1.

Figure 7:
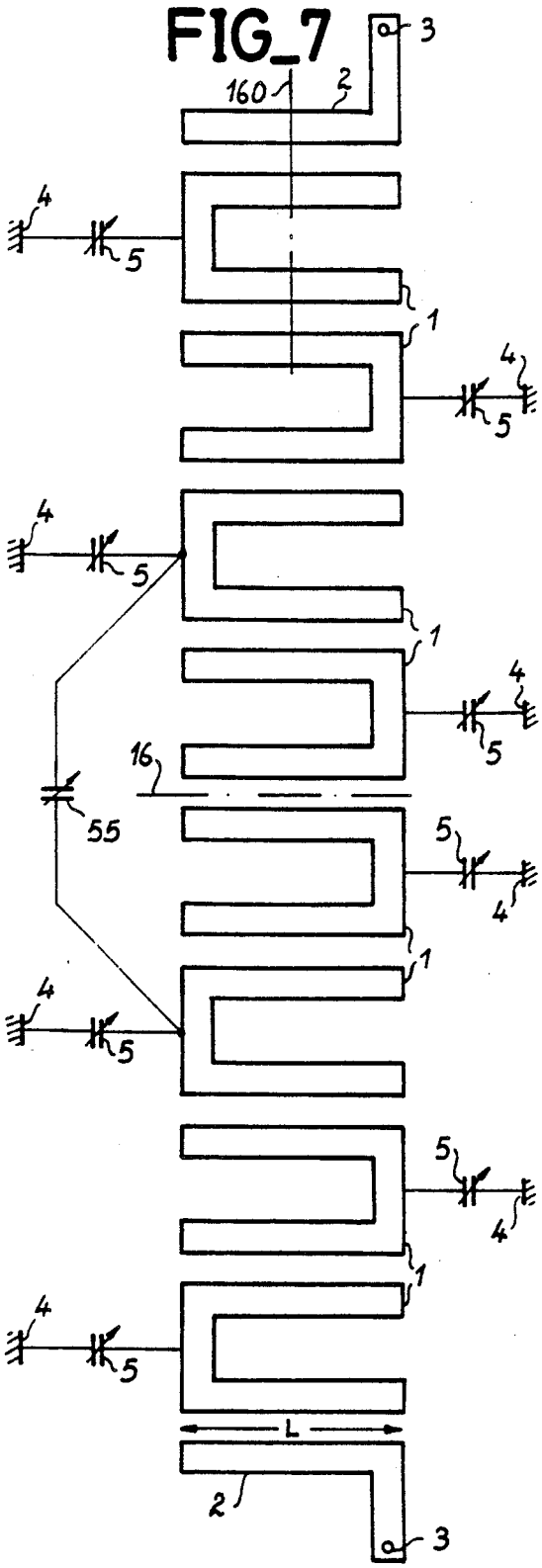
FIG. 7 is a fifth example of construction of a filter in accordance with the present invention.

In FIG. 7, there is shown an alternative embodiment of the filter of FIG. 6. The base of each hairpin resonator 1 is connected to a first plate of a variable capacitor 5. The second plate of said variable capacitor is connected to ground 4.

Advantageously, the connection of the base of the hairpin resonators 1 to the first plate of the variable capacitors 5 is carried out at the location of an axis of symmetry 15 of said hairpin resonator 1. In FIG. 7, the capacitors 5 are shown externally of the hairpins formed by the resonator 1. It is readily apparent that it would not constitute any departure from the scope of the present invention to connect the variable capacitors 5 within the interior of the hairpins formed by the resonator 1.

The presence of variable capacitors 5 permits fine adjustment of the filter.

Moreover, the length L of the arms of the hairpin resonators 1 is shorter in the case of the device of FIG. 7 than the length of the device of FIG. 1 or of FIG. 6. The length L is shorter than $\lambda_g/8$, where $\lambda_g$ is the guided wavelength at the center frequency of the filter. Thus filters of the type illustrated in FIG. 7 are of smaller size. This reduction in overall size is particularly important for the construction of filters forming part of on-board equipment such as those placed on board aircraft or satellites, for example.

Figure 8:
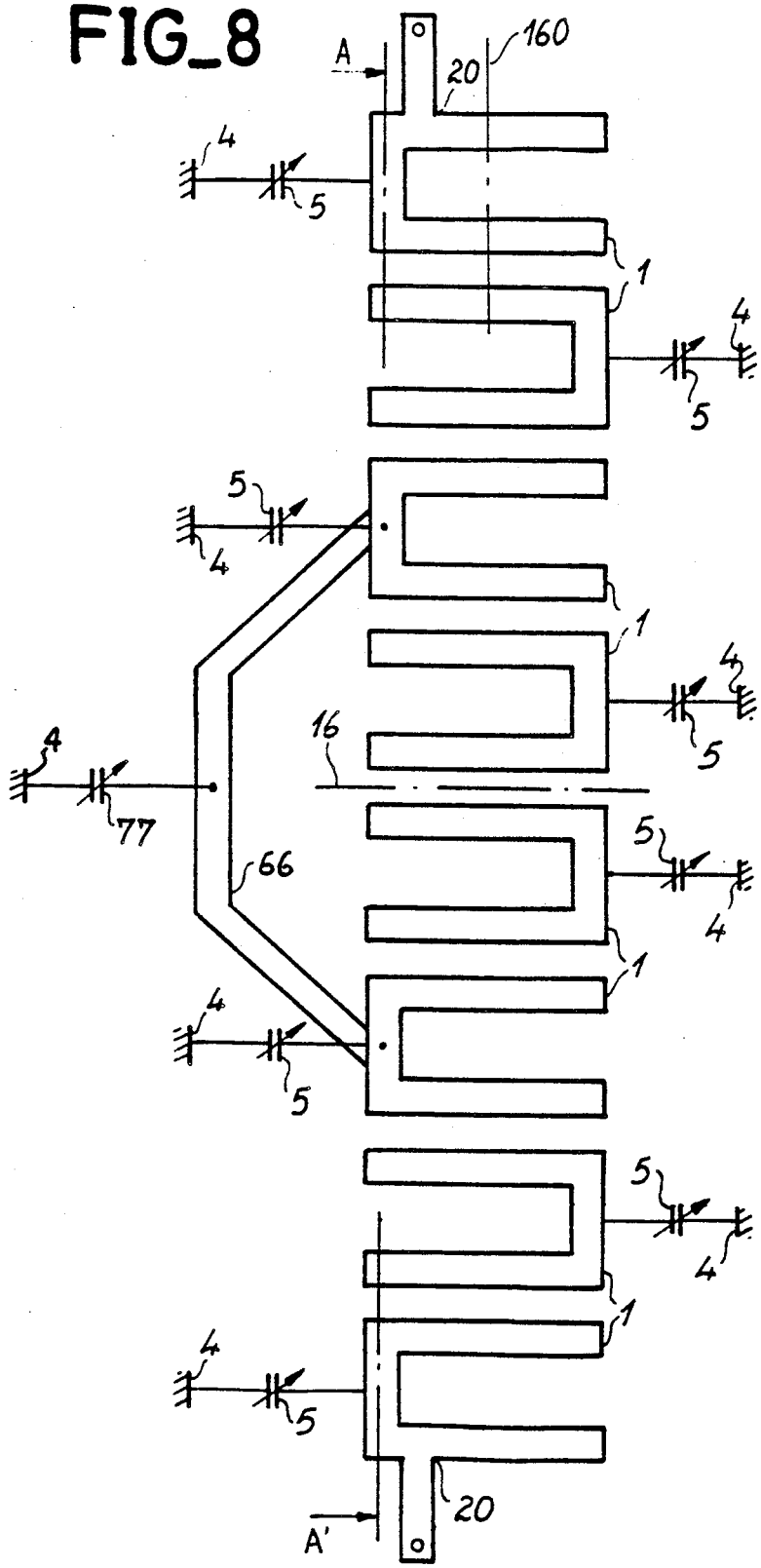
FIG. 8 is a sixth example of construction of a filter in accordance with the present invention.

In FIG. 8, there is shown an alternative embodiment of the device of FIG. 7. The hairpin resonators 1 are connected by means of a transmission line 66, a variable capacitor 77 being connected between the center of said line 66 and ground 4. In the case of this figure, the connected resonators are respectively the third and sixth hairpin resonators 1. When the frequency is increased (UHF, L-band, and so on), the value of the capacitor 55 becomes very low. On the other hand, the value of the capacitor 77 remains more readily achievable.

In FIG. 8, there is illustrated an example of construction in which a direct coupling 20 is employed as a connection means. The direct coupling 20 is a metallization which is directly connected to the first and last hairpin resonators 1. The direct coupling 20 makes it possible to solve the problem of realization of couplings of the type shown in FIG. 7. In the case of wide passbands, etching of the coupling space is in fact very narrow ($<100\ \mu m$). The location of the hairpin resonator arm at which the direct connection 20 is effected is determined by computation, for example by employing the specific computations developed for determination of the elements of the filter. The end metallization connection 20 which constitutes the direct coupling is formed by means of a metallized hole 3, for example. It is readily apparent that the direct connection is not limited to the example of construction shown in FIG. 8 but may be employed in all examples of construction of the filter in accordance with the present invention.

Figure 9:
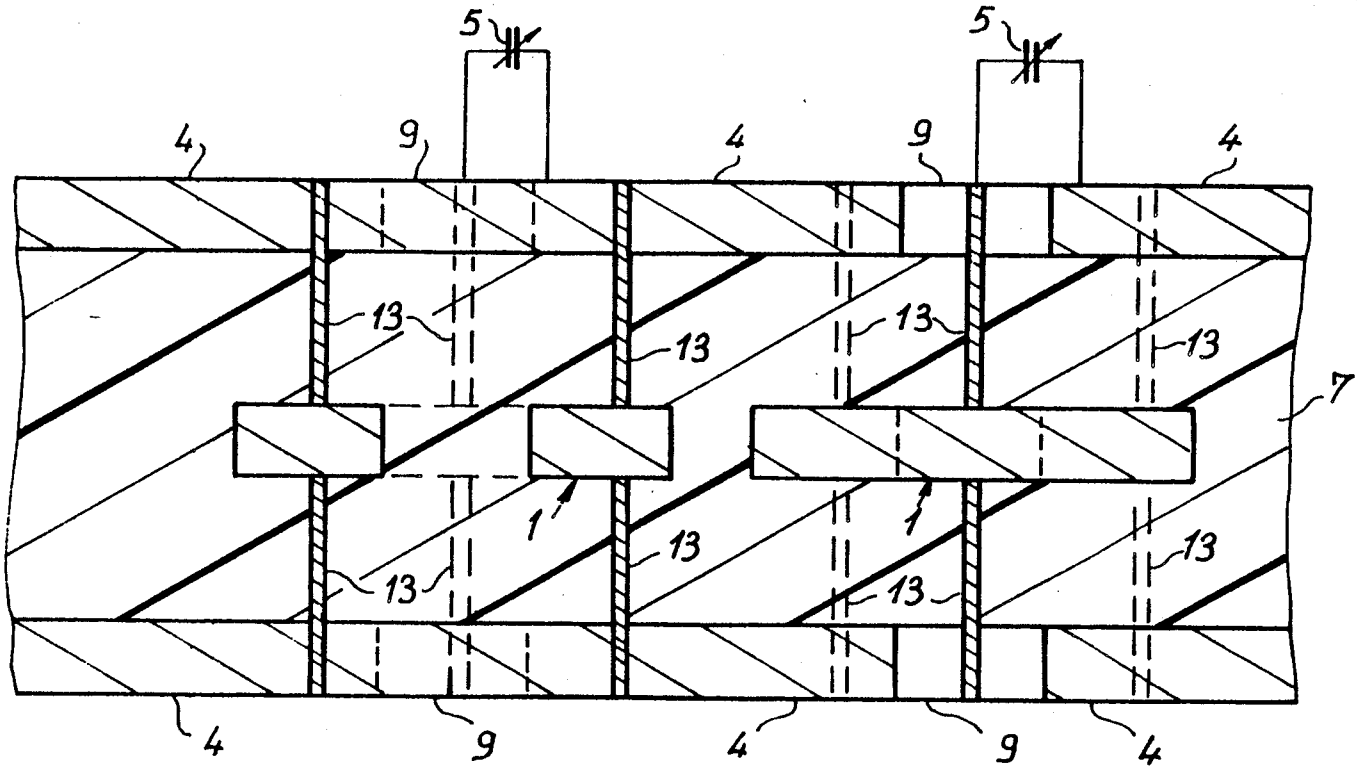
FIG. 9 is a sectional view taken along line A—A′ of FIG. 8.

Advantageously, the filters 1 in accordance with the present invention are fabricated by using three-plate technology. One example of construction of a filter in three-plate technology is illustrated in FIG. 9. This figure corresponds to a detail of construction of the filter of FIG. 8 taken in cross-section along the axis A—A'. In the three-plate technology, the hairpin resonators 1 are placed substantially in a plane which is included in a low-loss dielectric 7. At least two faces of the dielectric are covered with a metallization deposit which constitutes the ground plane 4. Advantageously, the low-loss dielectric 7 forms a rectangular parallelipied, the six faces of which are covered with metallization deposits forming the ground plane 4 of said filter. The vertical connections are designated by the reference label 13. They make it possible on the one hand to connect the ends of the arms of the hairpin resonator 1 to the ground plane 4 and on the other hand to connect the variable capacitor 5 to the base of the hairpin resonator 1.

In the example illustrated in FIG. 9, the metallization deposit of the ground plane 4 is provided with resists 9 so as to prevent short-circuits between the bases of the hairpin resonators and ground.

The variable capacitors 5 are shown diagrammatically in FIG. 9. In a real example, the variable capacitors 5 are implanted for example in the surface of the filter in accordance with the present invention. In the event that the filter of the invention is enclosed in a hermetically sealed package, the screws for adjusting the variable capacitors 5 may be allowed to project to the exterior.

Fabrication in the three-plate technology is not limited to the example of construction of the filter in accordance with the invention as shown in FIG. 6. The three-plate technology is applicable to all the filters in accordance with the present invention.

Figure 10:
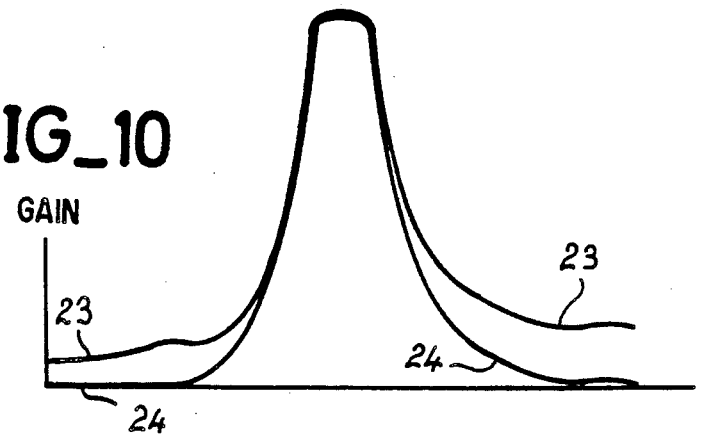
FIG. 10 is a curve showing the performance of the device of FIG. 9.

FIG. 10 shows the curve of response (gain vs. frequency plot) of two identical filters, one of which is fabricated in the microstrip technology whilst the other is fabricated in the three-plate technology. Curve 24 corresponds to the three-plate technology. Curve 23 corresponds to the microstrip technology. The generated noise is lower in the three-plate technology and the gain is of the order of 10 dB. Reduction in frequency pulling is particularly important in applications which require good rejection of parasitic signals.

Figure 11:
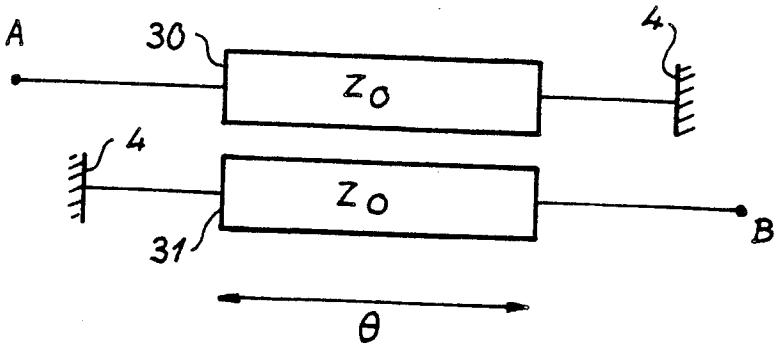
FIG. 11 is a representation of a first coupling employed in the device in accordance with the present invention.

In FIG. 11, there is shown a schematic representation of a first coupling between two resonators 1. The coupling is effected in FIG. 11 between two lines 30 and 31 having an impedance ZO and a length equal to the electrical angle $\theta$. The line 30 has an input at the point A and a connection to ground 4. The line 31 has an output at a point B opposite to the point A and a connection to ground 4.

Figure 12:
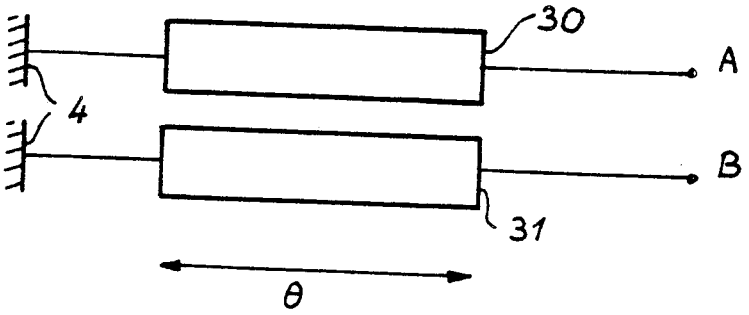
FIG. 12 shows a second coupling employed in the filters in accordance with the present invention.

FIG. 12 is a schematic representation of a second coupling between two resonators 1. In this figure, the coupling is effected between two lines 30 and 31 corresponding for example to a coupling between the fourth and the fifth resonators of FIG. 8. The line 30 has an input at the point A and a connection to ground 4. The line 31 has an output at a point B located on the same side of the line 31 as the point A and a ground connection 4.

Figure 13:
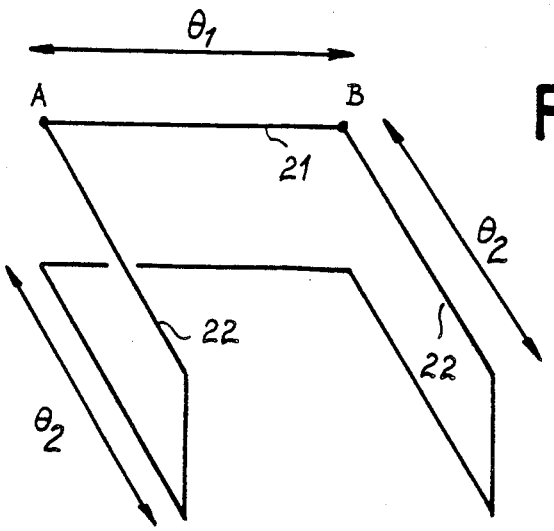
FIG. 13 is an equivalent diagram of the coupling of FIG. 11.

In FIG. 13, there is shown an equivalent diagram of a portion of the filter in accordance with the present invention and as illustrated in FIG. 11 which is based on the book by Matthaei, 1980 edition, entitled "Microwave Filters, Impedance Matching Networks and Coupling Structures". A portion corresponding to two coupled arms of the two resonators 1 (the capacitor 5 is not shown in the equivalent diagram) corresponds to a series line 21 having an electrical angle $\theta_1$ and two parallel lines 22 or so-called stubs having an electrical angle $\theta_2$. The stub 21 having an electrical angle $\theta_1$ corresponds to the coupling between two resonators. The stub 22 having an electrical angle $\theta_2$ corresponds to the arms of the hairpin resonators 1. Advantageously, the filter to be obtained is translated in the form of an equivalent diagram by making use of the criteria given in the work by Matthaei. It is thus possible to employ a computerassisted conceptual logic for the construction of the filters. It is possible, for example, to use the CAO, ESOPE, SUPER-COMPACT or TOUCHSTONE filter calculation systems.

Advantageously, translation is performed by a computer which is provided with an indication of the filter to be obtained.

Figure 14:
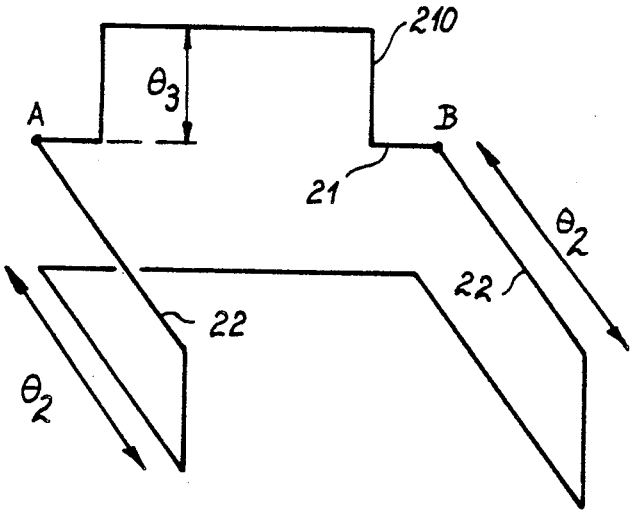
FIG. 14 is an equivalent diagram of the coupling of FIG. 12.

In FIG. 14, there is shown an equivalent diagram of a portion of filter in accordance with the present invention and corresponding to the representation of FIG. 12. The equivalent diagram of FIG. 14 differs from the equivalent diagram of FIG. 13 by the presence of a series stub 210 having an electrical angle $\theta_3$ between the points A and B.

Figure 15:
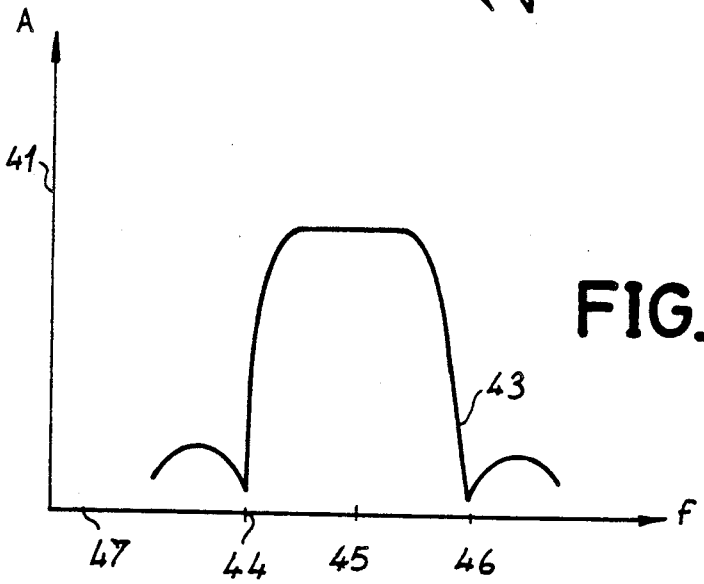
FIG. 15 is a curve of response of a filter in accordance with the present invention.

In FIG. 15, there can be seen the frequency response (gain vs. frequency plot) of one example of construction of the filter in accordance with the present invention.

The frequency f is placed on the axis of abscissa 47 and the amplitude A is placed on the axis of ordinates 41. By way of example, said axis of ordinates is an axis having a logarithmic scale.

One example of frequency response of the filter in accordance with the present invention is designated by the reference 43. This filter makes it possible to obtain two zeros centered on the frequencies 44 and 46 which may be disposed, for example, symmetrically with respect to the center frequency 45 of the filter. By way of example, the zeros 44 and 46 of the filter will be superimposed on frequency side lobes in the electric signal to be filtered since these latter would otherwise be very troublesome.

Advantageously, in order to obtain an envelope filter starting from the point 44 and before the point 46, the curve 43 is substantially vertical. On the greater part which is centered about the frequency 45, the curve 43 is substantially horizontal.

The technology in accordance with the present invention can be employed starting from high radio-wave frequencies and is particularly effective in the VHF band, in the UHF band and in the L band.

The invention is primarily applicable to the construction of filters, in particular microwave filters and to the device which makes use of filters of this type.

What is claimed is:

1. A microwave filter having a plurality of U-shaped resonators, wherein each of said resonators includes two parallel arms with one end of each arm being connected to a base and the other end of each arm being an open end, wherein any two successive resonators of said plurality of resonators being coupled in series by a respective electromagnetic coupling zone provided therebetween, a first one and a last one of said plurality of resonators being respectively connected to filter input/output connection means, wherein said filter has a longitudinal axis oriented transverse to each of said arms and an axis of symmetry oriented parallel to said arms and wherein said respective electromagnetic coupling zone between certain successive resonators is so arranged that adjacent open ends of said successive resonators are located on the same side of said longitudinal axis, and said respective coupling zone between certain other successive resonators so arranged that said ends are located in opposite relation with respect to said longitudinal axis; and wherein said plurality of U-shaped resonators are disposed symmetrically with respect to said axis of symmetry of said filter, and wherein two symmetrically disposed U-shaped resonators have their bases connected electrically together by means of a variable capacitor.

2. A filter according to claim 1, wherein said base of each U-shaped resonator of said plurality of U-shaped resonators is connected to a first plate of a respective capacitor with a second plate of said respective capacitors being connected to ground.

3. A filter according to claim 1, wherein said plurality of U-shaped resonators are placed substantially in a plane which is included in a low-loss dielectric, said dielectric having at least two faces covered by metallization deposit which constitutes a ground plane of said filter.

4. A filter according to claim 3, wherein said low-loss dielectric forms a rectangular parallelepiped having six faces covered with metallization deposits which forms the ground plane of said filter.

5. A filter according to claim 1, wherein at least one of said open ends of said arms of said plurality of U-shaped resonators are electrically connected to ground.

6. A microwave filter having a plurality of U-shaped resonators, wherein each of said resonators includes two parallel arms with one end of each arm being connected to a base and the other end of each arm being an open end, wherein any two successive resonators of said plurality of resonators being coupled in series by a respective electromagnetic coupling zone provided therebetween, a first one and a last one of said plurality of resonators being respectively connected to filter input/output connection means, wherein said filter has a longitudinal axis oriented transverse to each of said arms and an axis of symmetry oriented parallel to said arms and wherein said respective electromagnetic coupling zone between certain successive resonators is so arranged that adjacent open ends of said successive resonators are located on the same side of said longitudinal axis, and said respective coupling zone between certain other successive resonators so arranged that said open ends are located in opposite relation with respect to said longitudinal axis; and wherein said plurality of U-shaped resonators are disposed symmetrically with respect to said axis of symmetry of said filter, and wherein two symmetrically disposed resonators have their bases connected electrically together by means of a transmission line, an adjustable capacitor being connected between the center of said transmission line and ground.

7. A filter according to claim 6, wherein said base of each U-shaped resonator of said plurality of U-shaped resonators is connected to a first plate of a respective capacitor with a second plate of said respective capacitors being connected to ground.

8. A filter according to claim 6, wherein said plurality of U-shaped resonators are placed substantially in a plane which is included in a low-loss dielectric, said dielectric having at least two faces covered by metallization deposit which constitutes a ground plane of said filter.

9. A filter according to claim 8, wherein said low-loss dielectric forms a rectangular parallelepiped having six faces covered with metallization deposits which forms the ground plane of said filter.

10. A filter according to claim 6, wherein at least one of said open ends of said arms of said plurality U-shaped resonators are electrically connected to ground.

* * * * *